US005657788A

United States Patent [19]

Jrolf

[11] Patent Number: 5,657,788

[45] Date of Patent: Aug. 19, 1997

[54] LIQUID STORAGE CONTAINER WITH INSULATED CASING ENCLOSING EMERGENCY RELIEF VENT

[75] Inventor: James J. Jrolf, Kansas City, Mo.

[73] Assignee: WE-MAC Manufacturing, Kansas City, Mo.

[21] Appl. No.: 513,537

[22] Filed: Aug. 10, 1995

[51] Int. Cl.[6] ..... B65D 90/06

[52] U.S. Cl. ..... 137/264; 137/587; 220/203.01

[58] Field of Search ..... 137/264, 587; 220/464, 360, 361.1, 203.01

[56] References Cited

U.S. PATENT DOCUMENTS

| | | |
|---|---|---|
| 150,606 | 5/1874 | Perkins . |
| 450,494 | 4/1891 | Proctor . |
| 923,183 | 6/1909 | Johnson . |
| 1,263,751 | 4/1918 | Elkins . |
| 1,331,615 | 2/1920 | Brady . |
| 1,562,991 | 11/1925 | Rudigier . |
| 1,588,863 | 6/1926 | Walker . |
| 1,604,257 | 10/1926 | Brooks . |
| 1,908,684 | 5/1933 | Buchanan . |
| 2,056,179 | 10/1936 | Fitch . |
| 2,141,638 | 12/1938 | Bean . |
| 2,189,945 | 2/1940 | Fitch . |
| 2,259,319 | 10/1941 | Norbom . |
| 2,285,830 | 6/1942 | Paget . |
| 2,307,616 | 1/1943 | Booth . |
| 2,327,475 | 8/1943 | Waugh . |
| 2,425,962 | 8/1947 | Sill . |
| 2,757,823 | 8/1956 | Blanchard et al. . |
| 2,784,747 | 3/1957 | Weempe . |
| 2,792,148 | 5/1957 | Goldenberg . |
| 3,172,566 | 3/1965 | Mullin et al. . |
| 3,172,581 | 3/1965 | Nanni . |
| 3,240,388 | 3/1966 | Brainard . |
| 3,366,280 | 1/1968 | Sampson et al. . |
| 3,601,284 | 8/1971 | Yamawaki . |
| 3,782,599 | 1/1974 | Luginbuhl . |
| 3,827,455 | 8/1974 | Lee ..... 137/264 X |
| 3,863,687 | 2/1975 | Alquist . |
| 3,889,701 | 6/1975 | Muller . |
| 4,131,214 | 12/1978 | Rogers . |
| 4,249,392 | 2/1981 | Hotta . |
| 4,354,620 | 10/1982 | Tsuneda et al. . |
| 4,376,489 | 3/1983 | Clemens ..... 137/264 X |
| 4,397,405 | 8/1983 | Batson . |
| 4,403,075 | 9/1983 | Byrd et al. . |
| 4,469,129 | 9/1984 | Dixon . |
| 4,541,545 | 9/1985 | Beattie et al. . |
| 4,561,292 | 12/1985 | Pugnale et al. . |
| 4,615,362 | 10/1986 | Hartman et al. . |
| 4,638,928 | 1/1987 | Webster . |
| 4,784,902 | 11/1988 | Crompton . |
| 4,807,675 | 2/1989 | Sharp . |
| 4,842,139 | 6/1989 | Krieg . |
| 4,881,579 | 11/1989 | Sharp . |

(List continued on next page.)

FOREIGN PATENT DOCUMENTS

| | | |
|---|---|---|
| 944916 | 3/1961 | United Kingdom . |
| 1007251 | 10/1965 | United Kingdom . |

*Primary Examiner*—Kevin Lee

*Attorney, Agent, or Firm*—Kokjer, Kircher, Bowman & Johnson

[57] ABSTRACT

A volatile liquid storage facility having an inner tank containing a fuel storage chamber for retaining volatile fuel. An outer tank is formed surrounding and arranged concentric with the inner storage tank. The inner and outer tanks are spaced apart from one another by a predefined spacing which is filled with a fire retardant insulative material. The insulative material resists transfer of thermal energy between the inner and outer tanks. A vent is provided in communicating relation with the fuel chamber and projected outward therefrom. The vent passes through the insulative layer and through the outer tank to allow vapor to escape from the fuel chamber when a pressure therein exceeds a desired threshold level. An insulative shell is mounted to the exterior of the outer tank to enclose the vent in order to substantially isolate the vent from external environmental heat.

15 Claims, 1 Drawing Sheet

U.S. PATENT DOCUMENTS 4,911,326 3/1990 McGouran, Jr. .
4,988,020 1/1991 Webb .
5,012,949 5/1991 McGarvey et al. .
5,032,447 7/1991 Bailey .
5,033,637 7/1991 Webb .
5,038,456 8/1991 McGarvey .
5,081,761 1/1992 Rinehart et al. .
5,082,138 1/1992 McGarvey .
5,092,024 3/1992 McGarvey .
5,103,996 4/1992 McGarvey .
5,104,700 4/1992 Peterson .
5,251,473 10/1993 Reese ..... 137/264 X
5,305,926 4/1994 Webb .

LIQUID STORAGE CONTAINER WITH INSULATED CASING ENCLOSING EMERGENCY RELIEF VENT

BACKGROUND OF THE INVENTION

1. Field of the Invention

The present invention is generally related to a liquid storage device, such as a fuel tank and the like. More specifically, the invention is related to a volatile liquid storage device having a thermally insulated emergency relief vent mounted thereon.

2. Description of the Related Art

In the past, above ground storage tanks have been proposed for storing fuel and other volatile liquids. Examples of such systems are set forth in U.S. Pat. No. 5,305,926; U.S. Pat. No. 5,033,637 and U.S. Pat. No. 4,988,020. These patents are incorporated herein by reference. The foregoing storage tanks are primarily intended for use at modern airports having facilities for refueling airplanes. Conventional fuel tanks have been proposed to avoid the need for a below-ground storage tank since these underground tanks require substantial labor and time for installation. Below ground tanks are also less easily inspected to locate leaks. Also, below ground tanks are not movable to different locations.

The above-noted patents have proposed fueling systems containing above-ground tanks. However, above-ground tanks are exposed to environmental conditions, such as the possibility of fire or explosions at the surrounding facility. To address this concern, the '926 patent proposes an above-ground tank having a storage tank received within an outer tank to form an interstitial space therebetween. This interstitial space is filled with a fire retardant insulation material, such as a ceramic fiber blanket, to protect the internal storage tank from external temperature conditions which would otherwise cause the fuel to expand or contract. When a fire occurs proximate the exterior of the tank, the insulation material retards transmission of heat to the storage tank to provide extra time which could be used to extinguish the fire or to escape from the vicinity.

However, the tank configuration of the '926 patent has met with limited success in insulating the interior storage tank from such adverse environmental conditions. The storage tank of the '926 patent, as in most conventional storage tanks, includes a plurality of vents, fill spouts and the like which function as passages affording access to the interior of the storage tank. The vents include emergency vents provided on the upper surface of the tank in communicating with the storage chamber to allow vapor to escape and to afford safe burn off in the event of a catastrophic fire or other emergency. Pressure and vacuum vents are also provided in an upper surface of the outer tank which communicate with the storage tank to open when subjected to predefined pressure variations to allow vapor to escape during normal operating conditions. Similarly, a fill spout and the like may be provided upon the top of the tank. Each of the foregoing vents and fill spouts are formed from a pipe or similar structure which projects radially inward through the outer tank through the insulative material and into the interior storage tank. The vent pipes are generally formed of metal which is highly thermally conductive. In addition, the interior passage of the vent pipes and fill spouts represent a void simply containing air which also functions as a relatively good thermal conductor. Accordingly, during a fire, heat is transferred through the walls of the vent pipes and through the air passage past the insulative layer directly to the shell of the interior storage tank. Such thermal transfer significantly reduces the effectiveness of the insulative layer between the inner and outer storage tanks. Thermal conduction is further enhanced due to the fact that the relief vents are relatively large in diameter, thereby affording passageways having large cross-sections and a pipe having a large circumference to facilitate thermal transfer.

This deficiency of the tank proposed in the '926 patent is of primary importance when using the tank in federally regulated applications. Above-ground fueling facilities in certain applications are regulated under federal guidelines and thus a storage facility must satisfy certain federal safety ratings. By way of example, the National Fire Prevention Association code requires that tanks in some applications, such as aviation fuel storage facilities, have a UL-2085 listing. As is understood in the field, a tank having "UL-2085 listing" has been tested and found to be able to withstand submission to temperatures of 2000° F. for a period of two hours without exceeding a maximum temperature rise of 1000° F. and without exceeding the maximum average temperature rise of 800° F. Achieving a UL-2085 listing is highly desirable as it is one of the higher safety standards.

Tanks such as proposed in the '926 patent have not been able to achieve a UL-2085 listing in a cost effective manner. The tank of the '926 patent utilizes several inches of insulating material between the inner and outer tanks to minimize thermal transfer therebetween. However, as noted above, the thermal insulative effect of the insulation layer is substantially reduced by heat transfer through the relief vents and the like. To compensate for such loss in efficiency, the thickness of the insulation layer has been increased. However, the cost of the fuel tank increases with the thickness of the insulation layer. Accordingly, the tank of the '926 patent has been unable to achieve a "UL-2085 listing" while using a cost effective amount of insulation.

Hence, a need remains within the industry for an improved storage facility which minimizes the transfer of thermal energy between the interior and the exterior of the tank while minimizing the cost of the materials used therein.

SUMMARY OF THE INVENTION

Accordingly, it is an object of the present invention to provide an improved storage tank which minimizes the transfer of thermal energy to the fuel chamber within the tank.

It is a corollary object of the present invention to provide a storage tank which minimizes the amount of insulative material therein.

It is a further object of the present invention to limit the thermal transfer characteristics of the relief vents by insulating these vents.

It is a corollary object of the present invention to reduce heat transfer through passages within relief vents and the like by filling such passages with insulative material.

It is an overall object of the present invention to provide an insulated fuel storage facility capable of achieving a "UL-2085 listing" while limiting the thickness of a thermal insulative layer about the tank.

These and other objects of the present invention are provided by forming a volatile liquid storage facility having an inner tank containing a fuel storage chamber for retaining volatile fuel. An outer tank is formed surrounding and arranged concentric with the inner storage tank. The inner and outer tanks are spaced apart from one another by a predefined spacing which is filled with a fire retardant insulative material. The insulative material resists transfer of thermal energy between the inner and outer tanks. A vent is provided in communicating relation with the fuel chamber and projected outward therefrom. The vent passes through the insulative layer and through the outer tank to allow vapor to escape from the fuel chamber when a pressure therein exceeds a desired threshold level. An insulative shell is mounted to the exterior of the outer tank to enclose the vent in order to substantially isolate the vent from external environmental heat while allowing pressurized vapor to escape from the vent.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
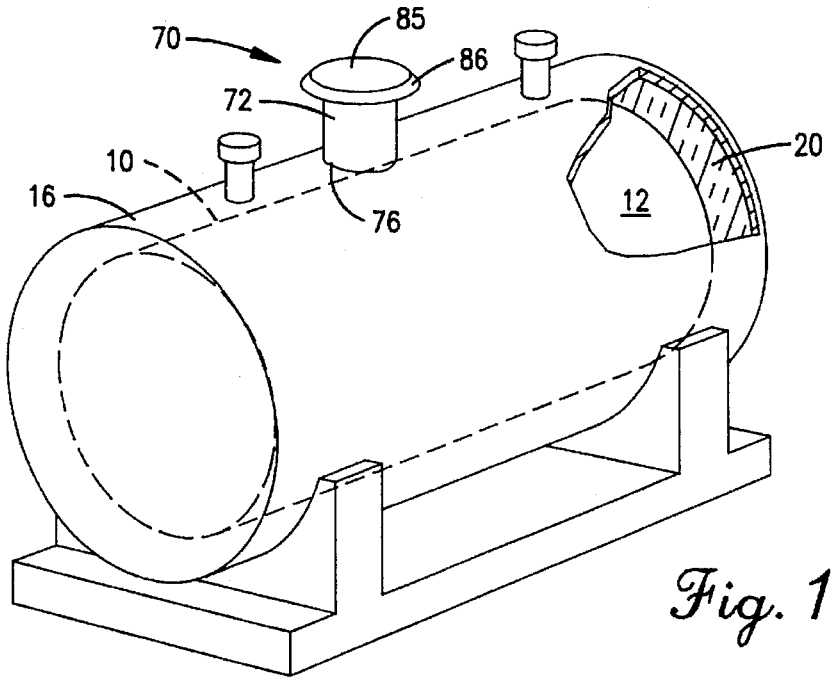
FIG. 1 illustrates a perspective view of a storage tank according to the present invention.

FIG. 1 generally illustrates a storage tank having an inner tank 10 (defined in shadow lines) with a fuel chamber 12 therein for storing volatile fuel 14. The tank may be aligned horizontally or vertically and supported within a saddle-shaped base and the like. The inner tank is surrounded by an outer tank 16 and arranged concentric therewith. The exterior diameter of the inner tank 10 is somewhat less than the interior diameter of the outer tank 16 to form a spacer gap 18 therebetween. The spacer gap 18 is filled with an insulative material 20 for resisting the transfer of thermal energy between the inner and outer tanks 10 and 16. The thickness of the insulative layer 20 is governed by the thickness of the spacer gap 18. The insulative layer 20 may be varied in thickness to achieve different insulative ratings.

The overall storage tank includes a fill spout 22 and a pump for discharging fuel. These conventional features of the storage tank are not described in detail as they are known and disclosed in alternative forms, such as in the above cited patents which have been incorporated herein by reference. It is to be understood that other conventional systems may be utilized for adding fuel to, and withdrawing fuel from, the tank.

Figure 2:
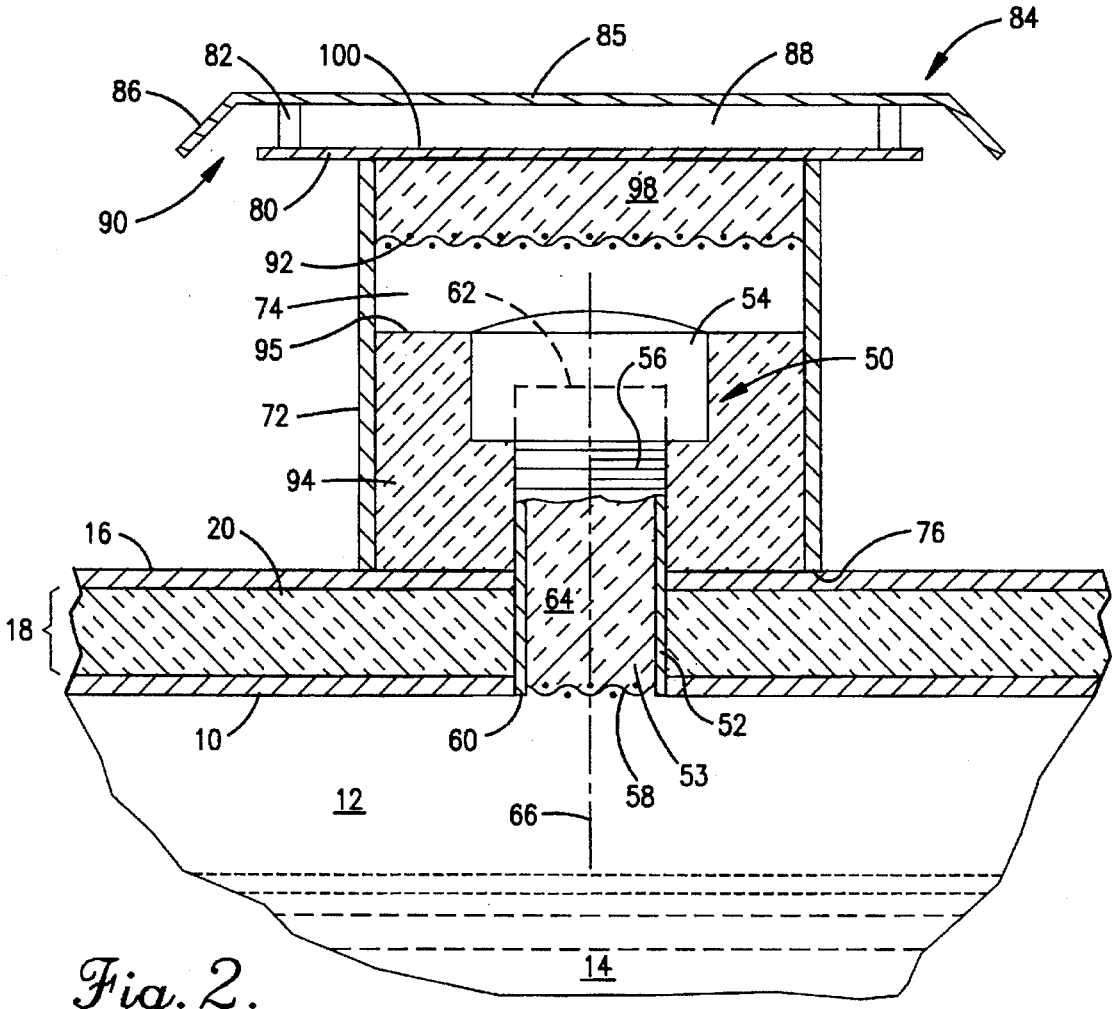
FIG. 2 illustrates a side sectional view taken along line 2—2 in FIG. 1 of a safety vent and insulative shell assembly according to the present invention.

Turning to FIG. 2, the storage tank includes a vent assembly 50 mounted on the top side thereof for allowing vapor and the like to escape from the tank when the internal pressure within the chamber 12 exceeds a predefined threshold. The vent assembly 50 may be constructed in a variety of manners. By way of example, the vent assembly 50 may include a pipe 52 communicating with, and extending radially outward from, the inner tank 10. The pipe 52 may be formed in a tubular shape with inner and outer rims 60 and 62 aligned along a radial axis 66 projecting radially outward from the longitudinal axis of the inner tank 10. A passage 53 extends between inner and outer rims 60 and 62 to afford communication of the chamber 12 with the exterior environment. The pipe 52 extends through the insulative layer 20 and through the outer tank 16.

The inner rim 60 is securely mounted to the inner tank 10 proximate to, and surrounding an opening therein. The outer rim 62 of the pipe 52 includes threads about its exterior surface to threadably receive a cap 54 which closes the passage 53 during normal use. The cap 54 is forcibly discharged from the pipe 52 along axis 66 when sufficient pressure is produced within the chamber 12 to provide a passage between the chamber 12 and the exterior environment. Optionally, a mesh screen 58 may be provided to cover the opening into the inner tank 10 and to traverse the opening through the inner rim 60 of pipe 52. The mesh screen 58 forms an air transmissive barrier to outwardly pass vapor and liquids while resisting inward flow of fibrous solid materials. The screen 58 supports and retains an interior insulative layer of material 64 within the passage 53 of the pipe 52. The interior insulation layer 64 substantially retards the transfer of thermal energy through the passage 53 to prevent heat from entering the tank via the pipe 52. The screen 58 is formed with sufficiently small openings therethrough to form a barrier to particulate material. Optionally, the screen 58 may be replaced with a solid membrane which is air permeable or air tight to prevent penetration by vapors or liquids. The membrane may be detachably mounted to the inner tank 10 or rim 60 to be torn therefrom when vapor having a threshold pressure builds up within the chamber 12. Once the pressure exceeds the threshold, the membrane is compromised to admit vapor therethrough which is ultimately discharged from the upper rim 62 when the cap 54 is forcibly exhausted.

The vent assembly 50 is housed within an insulated shell 70 which thermally isolates the vent 50 from external environmental conditions surrounding the tank. In the preferred embodiment, the insulated shell 70 is formed with a tubular casing 72 having lower and upper edges 76 and 78 located at opposite ends thereof. The casing 72 forms an interior venting chamber 74 which encloses the vent assembly 50. The lower edge 76 of the casing 72 is secured to the exterior surface of the outer tank 16. In the preferred embodiment, the casing 72 is aligned with its longitudinal axis projecting radially outward from the exterior of the outer tank 16.

The upper edge 78 of the casing 72 is formed with a circular ring shaped peripheral flange 80 projecting outward therefrom. A plurality of spacer supports 82 are mounted on the upper surface of the flange 80 at evenly spaced intervals thereabout. Upper ends of the supports 82 securely receive a top plate 84 which may be dish-shaped with a peripheral rim or skirt 86 sloped downward from a central body section 85 thereof. The top plate 84 is supported above the flange 80 with an air space 88 therebetween, the width of which is defined by the supports 82. The body section 85 extends radially outward beyond the flange 80, while the rim 86 is sloped downward to cover the flange 80. The rim 86 is spaced radially outward from the flange 80 to form a peripheral exhaust port 90 to the air space 88 while preventing rain and the like from entering the air space 88. The air space 88 allows pressurized vapor to escape from the venting chamber 74 outward into the atmosphere, while the rim 86 prevents external environmental elements from entering the venting chamber 74. The pressurized vapor escapes from the chamber 12 through the passage 53 and through the venting chamber 74 to the air space 88 and out through the exhaust part 90 into the atmosphere.

The venting chamber 74 is partially filled with a peripheral insulation layer 94 to surround the exterior of the pipe 52 and the cap 54. In the preferred embodiment, the insulation layer 94 is filled to a level 95 substantially even with the top of the cap 54. The peripheral insulation layer 94 thermally isolates the pipe 52 and cap 54 from heat sources external to the shell 70. In this manner, the layer 94 prevents heat transfer along the body of the pipe 52 through the insulation layer 20 to the inner tank 10. Optionally, the amount of insulation within the layer 94 may be increased or decreased so long as adequate insulation is provided consistent with the present invention. Optionally, a mesh screen 92 may be secured to the inner surface of the casing 72 at an intermediate point 93 thereabout. The mesh screen 92 covers the entire venting chamber 74 to support an upper layer of insulation 98. The upper insulation layer 98 may be filled to any desired thickness, but is preferably filled to a level even with the upper edge 78 and flange 80 of the casing 72. The thickness of the insulation layer 98 may be increased or decreased so long as it maintains sufficient thermal isolation consistent with the present invention.

The insulation layers 64, 94 and 98 cooperate to substantially thermally isolate the vent pipe 52 from external environmental conditions. Hence, the insulation layers 64, 94 and 98 prevent heat from being transferred through the body of the pipe 52 and the passage 53 into the inner tank 10. The thermal isolating effect of the insulated shell 70 is particularly substantial when the vent assembly 50 is large. For instance, the vent assembly 50 may be several inches in diameter, thereby providing a cross-sectional passage having a large area which, but for the insulated shell 70, would expose the inner tank 10 directly to atmospheric conditions. However, the insulated shell 70 encloses this exposed region through the insulation layer 20, thereby maintaining the thermally isolated integrity of the inner tank 10.

During operation, when the tank 10 is exposed to substantial external heat, the insulated shell 70 has proven to have a thermal insulating rating of R/Value 7.0. This insulation rating reduces the heat transfer to the inner tank, thereby allowing an insulation layer 20 approximately 33% thinner to be utilized about the tank as compared to a layer 20 needed without the shell 70. By way of example, the instant invention has enabled a tank to be constructed having a UL-2085 safety rating, with the use of a two inch thick insulation layer 20 about the inner tank.

During operation, the pressure within the chamber 12 is delivered through the screen 58 and insulation layer 64 to the cap 54. If this pressure exceeds a predefined threshold, the cap 54 is discharged forcibly from the pipe 52 (such as by stripping the threads 56). The cap 54 is projected upward toward the top plate 84 and contacts the mesh screen 92. The screen 92 sufficiently flexes to enable the cap 54 to be completely discharged from the pipe 52 in order to enable pressurized vapor to escape from the chamber 12 via passage 53. However, the mesh screen 92 and/or top plate 84 retain the cap 54 within the venting chamber 74 as vapor escapes through the passage 53, the mesh screen 92, and through the insulation layer 98. The vapor thereafter travels through the air space 88 and is exhausted from the ports 90 into the atmosphere. In this manner, the insulated shell 70 thermally isolates the vent assembly 50 from external environmental conditions without inhibiting the normal venting operation of the assembly 50.

Optionally, the entire venting chamber 74 may be filled with insulation. Alternatively, the shell 72 may be constructed with a double wall with the gap between the walls filled with insulation.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A liquid storage facility, comprising:

an inner tank having a chamber therein for storing a liquid;

an outer tank surrounding and arranged concentric with said inner storage tank, said inner and outer tanks being spaced apart from one another by a predefined spacer gap;

insulation material disposed in said spacer gap for resisting transfer of thermal energy between said inner and outer tanks;

vent means communicating with said chamber and extending outward from said inner tank and through said insulation material and outer tank to an exterior environment, for allowing vapor to escape from said chamber when a pressure therein exceeds a desired threshold; and insulation means, mounted to an exterior of said outer tank and enclosing said vent means for substantially isolating said vent means from external environmental heat to which said outer tank is exposed.

2. A liquid storage facility according to claim 1, wherein said insulation means includes a casing with a top, the casing surrounding a portion of said vent means projecting outward beyond said outer tank, and a top plate mounted upon the top of said casing to form an insulated venting chamber.

3. A liquid storage facility according to claim 1, wherein said insulation means includes a peripheral layer of insulation surrounding an exterior portion of said vent means extending beyond an exterior of said outer tank.

4. A liquid storage facility according to claim 1, wherein said vent means includes a tubular pipe secured to said inner tank, said tubular pipe having a passage therethrough communicating with said chamber and wherein said insulation means includes a layer of insulation received within and partially filling said passage, said insulation layer resisting transfer through said passage of thermal energy between the external environment and said chamber.

5. A liquid storage facility according to claim 1, wherein said insulation means includes a tubular casing with a top plate mounted thereon and having a venting port therebetween, said casing and top plate surrounding a discharge port of said vent means to resist transfer of external heat through said discharge port and a wall of said vent means into said fuel chamber.

6. A volatile fluid storage container, comprising:

inner and outer containers arranged concentrically with one another, said inner container having a fluid chamber for storing volatile fluid;

a safety relief vent projecting through said inner and outer containers to form an emergency relief passage from said fluid chamber to an external environment; and an insulated shell enclosing a portion of said relief vent extending outward beyond said outer container, for preventing external heat from migrating inward through a wall of said vent and through said relief passage into said fluid chamber.

7. A volatile fluid storage container according to claim 6, further comprising an insulative layer of fire retardant material disposed between said inner and outer containers.

8. A volatile fluid storage container according to claim 6, wherein said insulated shell includes a casing with a top, the casing surrounding a portion of said relief vent projecting outward beyond said outer container, and a top plate mounted upon the top of said casing to form an insulated venting chamber.

9. A volatile fluid storage container according to claim 6, wherein said insulated shell includes a peripheral layer of insulation surrounding an exterior portion of said relief vent which extends beyond an exterior of said outer container.

10. A volatile fluid storage container according to claim 6, wherein said relief vent includes a tubular pipe secured to said inner container, said tubular pipe having a passage therethrough communicating with said fluid chamber and wherein said insulated shell includes a layer of insulation received within and partially filling said passage, said insulation layer resisting transfer through said passage of thermal energy between the external environment and said chamber.

11. A volatile fluid storage container according to claim 6, wherein said insulated shell includes a tubular casing with a top plate mounted thereon and having a venting port therebetween, said casing and top plate surrounding a discharge port of said relief vent to resist transfer of external heat through said discharge port and a wall of said relief vent means into said fluid chamber.

12. A method of forming a liquid storage facility, comprising the steps of:

forming a double walled storage tank with inner and outer walls for storing liquid in the inner wall;

filling an interstitial space between the inner and outer walls with a first layer of insulation to thermally isolate the inner wall from an exterior environment;

providing a relief vent between extending through said outer wall to discharge pressurized vapor, said vent extending through said layer of insulation; and thermally isolating said relief vent with a second layer of insulation, at least a portion of which is located outside said outer wall.

13. A method according to claim 12, wherein a portion of the relief vent extends beyond the exterior wall and further comprising:

surrounding a portion of said relief vent extending beyond said exterior wall with insulation.

14. A method according to claim 12, further comprising:

surrounding a portion of said relief vent extending beyond said exterior wall with insulation.

15. A method according to claim 12, further comprising:

forming a shell about said relief vent and filling said shell with insulation.

* * * * *